US005642723A

United States Patent [19]

Hogan

[11] Patent Number: 5,642,723

[45] Date of Patent: Jul. 1, 1997

[54] ELASTIC BAND PROJECTILE SLINGER

[76] Inventor: Howard W. Hogan, 3131 S. Shore Dr., Albany, Oreg. 97321

[21] Appl. No.: 557,366

[22] Filed: Nov. 13, 1995

[51] Int. Cl.[6] ..... F41B 7/04

[52] U.S. Cl. ..... 124/22; 124/20.3; 124/40

[58] Field of Search ..... 124/20.1, 20.3, 124/21, 22, 26, 27, 35.1, 40

[56] References Cited

U.S. PATENT DOCUMENTS

| | | | |
|---|---|---|---|
| 213,976 | 4/1879 | Coloney . | |
| 267,679 | 11/1882 | Crandall | 124/17 |
| 316,525 | 4/1885 | Cooper | 124/20.1 X |
| 348,860 | 9/1886 | Newbury | 124/25 |
| 1,877,215 | 9/1932 | Albisu . | |
| 2,762,358 | 9/1956 | Kinnaman . | |
| 2,995,128 | 8/1961 | Hornbostel . | |
| 3,265,054 | 8/1966 | Gruenenfelder . | |
| 3,490,429 | 1/1970 | Benedict | 124/25 X |
| 3,857,379 | 12/1974 | Burghardt . | |
| 3,949,729 | 4/1976 | Pfotenhauer . | |
| 4,192,281 | 3/1980 | King | 124/25 |
| 4,593,673 | 6/1986 | Kees . | |
| 4,693,228 | 9/1987 | Simonds et al. | 124/25 |
| 4,721,092 | 1/1988 | Waiser | 124/25 X |
| 4,860,719 | 8/1989 | Scheiterlein | 124/25 |
| 5,072,715 | 12/1991 | Barr | 124/20.1 |

*Primary Examiner*—John A. Ricci
*Attorney, Agent, or Firm*—Eugene M. Eckelman

[57] ABSTRACT

An elastic band projectile slinger has an elongated base forming an elongated projectile guide track along its length. A pivoted support plate on the front end of the base anchors a pair of elongated elastic bands which are stretchable to a releasable latch adjacent the rear end of the base. Release of the latch is controlled by a finger-operated trigger. An elongated arrow projectile is positionable in the guide track with the rear nock end of the arrow engaging a cord joining the rear ends of the elastic bands. The front end of the arrow has a point member of magnetically susceptible material and is secured in the guide track by a magnet mounted on the base. When the trigger is operated to release the latch, the contraction of the elastic bands moves the latch rapidly forward, releasing the elastic bands to contract in the forward direction and carry the arrow forwardly therewith. As the contracting bands move forwardly beyond the front end of the base, the support plate pivots forwardly and downwardly in front of the base to afford maximum extension of the bands and maximum thrust to the arrow.

15 Claims, 2 Drawing Sheets

FIG. 8
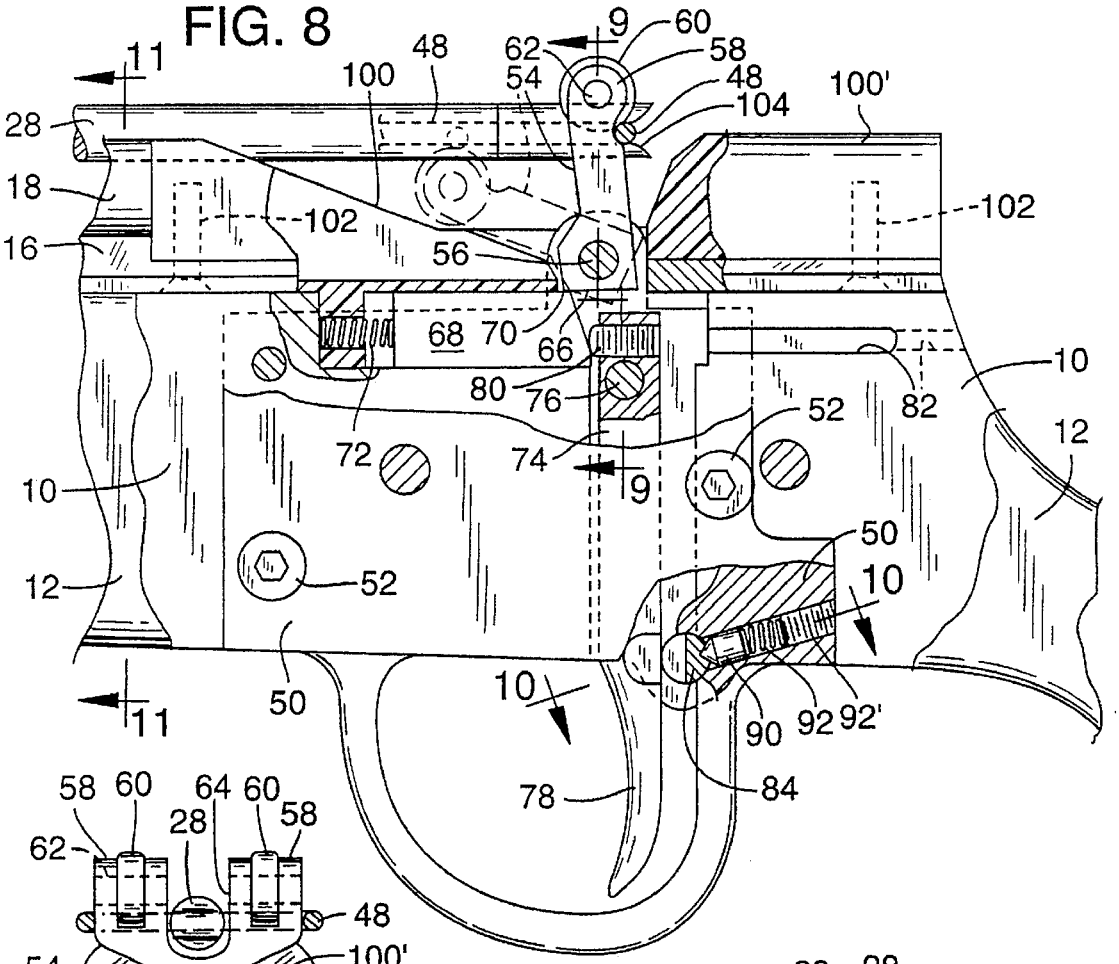
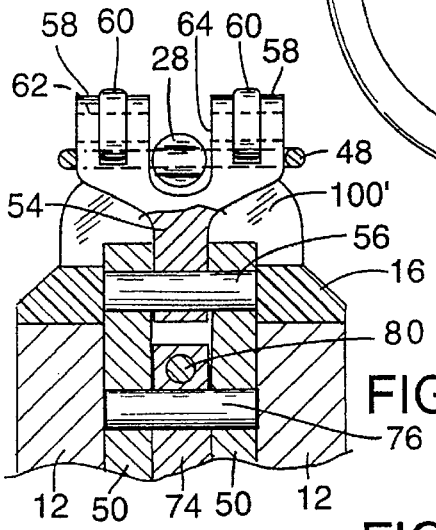
FIG. 9
FIG. 10
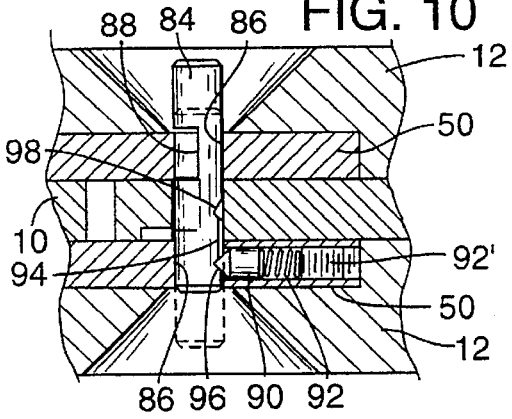
FIG. 11
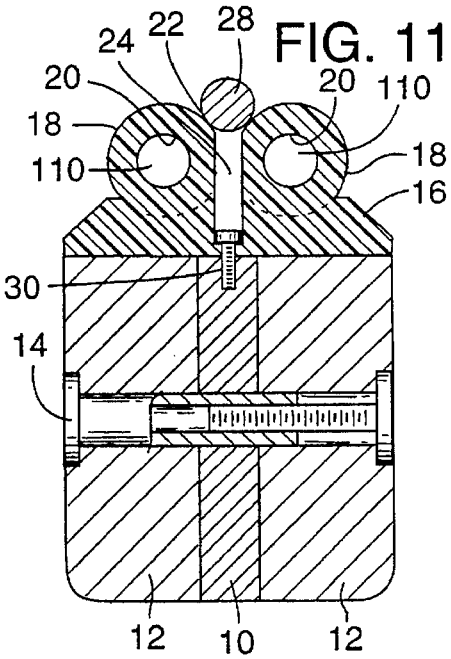

ELASTIC BAND PROJECTILE SLINGER

BACKGROUND OF THE INVENTION

This invention relates to elastic band slingshot-type guns, and more particularly to such a gun having improved operating characteristics.

Elastic band slingshot-type guns are well known in the art and are exemplified in U.S. Pat. Nos. 4,593,673; 3,949,729; 3,857,379; 3,265,054; 2,995,128; 2,762,358; 1,877,215; 267,679; and 213,976. These patents disclose generally accepted structural features which contribute adversely to performance of the gun. For example, the portion of the elastic band that engages the projectile is subjected to considerable friction as it is released from the cocked position. Also, the elastic band is limited in its forward thrust by terminating the band at a fixed anchor at the front end of the gun. Further, the guns cannot be carried in loaded condition while maneuvering over a hunting site or conducting other activity.

SUMMARY OF THE INVENTION

The elastic band projectile slinger of this invention attaches the ends of an elongated elastic strap to a hinged plate at the front end of a rifle-like stock and the central portion of the elastic strap is configured to engage an arrow, dart, or other projectile when the strap is stretched over a trigger-actuated, pivoted latch provided with rollers arranged for engagement by the strap for reduced friction during release.

It is the principal objective of this invention to provide an elastic band slingshot-type gun which overcomes the aforementioned disadvantages and limitations of prior guns of this type.

Another objective of this invention is the provision of an elastic band slingshot-type gun of the class described which includes a shock pad arranged for engagement by the pivoted latch to dampen the impact of the latter and protect the rollers.

Still another objective of this invention is to provide an elastic band slingshot-type gun of the class described which includes a simplified trigger mechanism that affords positive retention of the elastic strap in cocked condition and ready release by the trigger for firing, and positive locking against inadvertent firing.

A further objective of this invention is the provision of an elastic band slingshot-type gun of the class described which secures an arrow, dart, or other similar projectile in readiness for firing while allowing the gun to be carried during activity, such as walking over a hunting site.

A still further objective of this invention is to provide an elastic band slingshot-type gun of the class described which is of simplified construction for economical manufacture, maintenance and repair and provides precision of operation.

The foregoing and other objects and advantages of this invention will appear from the following detailed description, taken in connection with the accompanying drawings of a preferred embodiment.

BRIEF DESCRIPTION OF THE DRAWINGS

FIG. 8 is a fragmentary side elevation, on an enlarged scale, showing in partly sectioned areas the trigger and elastic band release mechanism of the slinger of FIG. 1.

FIG. 9 is a fragmentary sectional view taken on the line 9—9 in FIG. 8.

FIG. 10 is a fragmentary sectional view taken on the line 10—10 in FIG. 8.

FIG. 11 is a sectional view taken on the line 11—11 in FIG. 8.

DESCRIPTION OF THE PREFERRED EMBODIMENT

Figures 1, 2, 3, 4, 5, 6, 7:
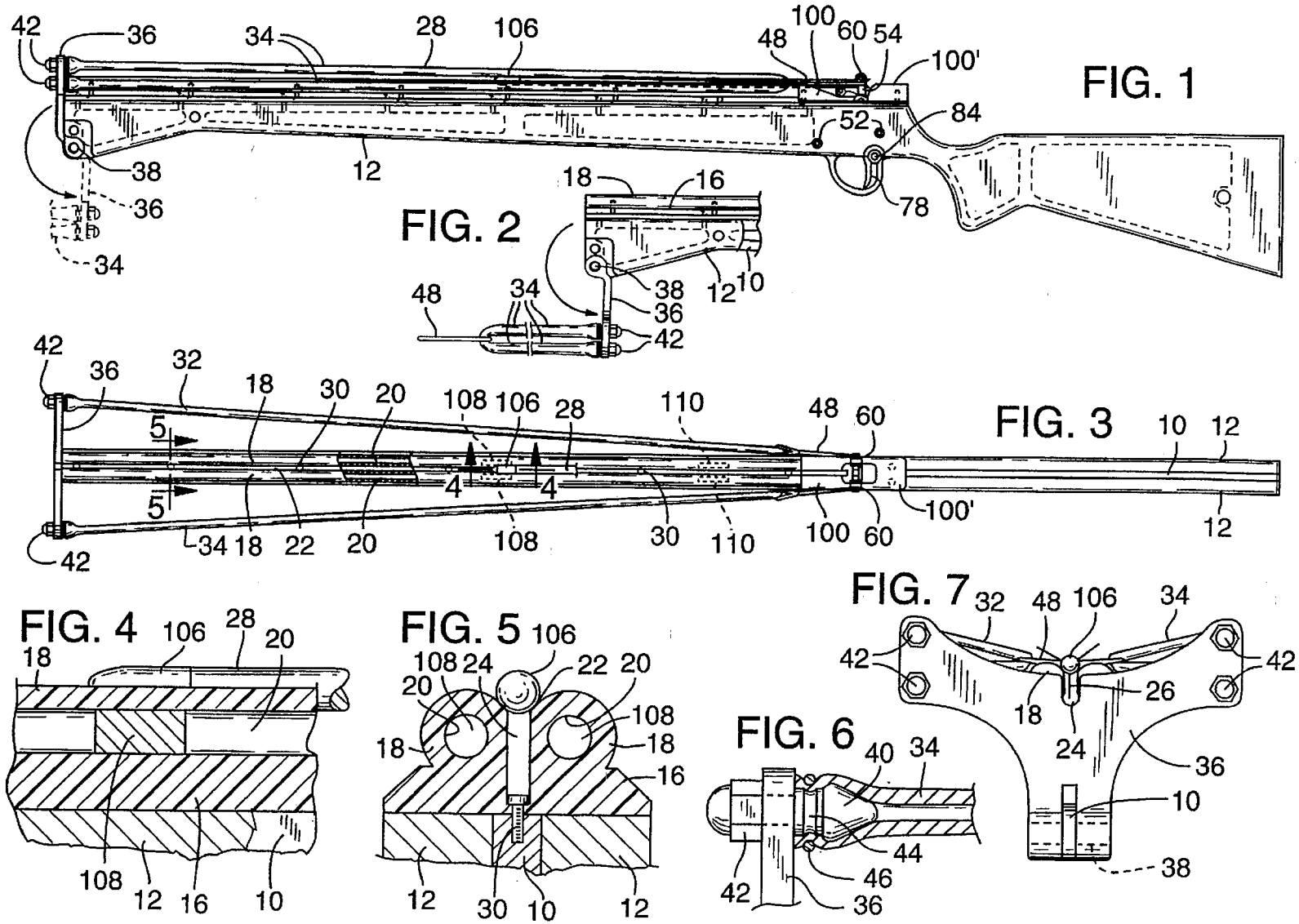
FIG. 1 is a side elevational view of an elastic band projectile slinger embodying the features of this invention.
FIG. 2 is a fragmentary, foreshortened side elevation showing the front elastic band anchor plate pivoted to the released position of the elastic band.
FIG. 3 is a plan view as viewed from the top in FIG. 1.
FIG. 4 is a fragmentary longitudinal sectional view, on an enlarged scale, taken on the line 4—4 in FIG. 3.
FIG. 5 is a fragmentary cross sectional view, on an enlarged scale, taken on the line 5—5 in FIG. 3.
FIG. 6 is a fragmentary side elevational view, on an enlarged scale, showing the manner of attachment of one of the elastic bands to the front anchor plate, the elastic band being shown in section as elastic tubing.
FIG. 7 is a front elevation, on an enlarged scale, as viewed from the left in FIG. 1.

Referring primarily to FIGS. 1 and 3 of the drawings, there is illustrated an elongated base plate 10 in the shape of a rifle stock. Weight reducing openings in the base plate are shown in broken lines. The base plate is covered with wooden side members 12 which are secured thereto by the attaching screws 14 (FIG. 11), to give the appearance of a rifle.

The upper side of the base plate supports an elongated projectile track base 16 which supports a pair of laterally spaced, elongated barrels 18 provided with axial bores 20, to simulate a rifle. The projectile track 22 is formed by the spaced barrels and registers with an inwardly extending slot 24 which serves to freely receive a feather 26 of a projectile arrow 28. In the embodiment illustrated, the track base and barrels, together with the associated barrel bores and feather slot, is formed as an integral unit of extruded thermoplastic resin. This extrusion is secured to the top surface of the base plate 10 by means of anchor screws 30.

A pair of elongated elastic straps 32 and 34, provided in the form of surgical tubing, are secured at the front end to a front anchor plate 36 which is secured pivotally to the front end of the base plate 10 by means of pivot pin 38. Each of the elastic tubings is secured to the pivot plate by means of an attachment stud 40 secured to the pivot plate by a nut 42. The stud is provided with an annular groove 44 over which the end of the surgical tubing is received, and a securing band 46 is wrapped about the tubing and seated in the groove.

The elastic straps 32 and 34 extend rearwardly from the pivot plate 36 and their doubled rear ends are interconnected by a connecting cord 48. This arrangement forms an elastic band.

Adjacent the rearward end of the base plate 10 is a trigger mechanism housing 50 secured to the base plate by attachment screws 52. The housing supports a releasable latch bar 54 which is secured thereto by pivot pin 56 extending transversely of the housing 50 to provide for pivoting of the latch bar in the fore and aft direction of the base plate. The outer end of the latch bar is bifurcated to form laterally spaced end sections 58 each of which is provided with a slot for the reception of a roller 60. The roller is supported for rotation on shaft 62.

The central space between the bifurcated ends of the latch bar provides a slot 64 for the reception of the rear end of a projectile.

The bottom end of the latch bar 54 is configured with a base surface 66 located immediately adjacent the rear end of a slide bar 68 mounted for longitudinal reciprocation in the housing 50. The base surface 66 and the adjacent upper surface of the slide bar 68 are formed with a mutual overlapping engagement area 70 by which the latch bar is retained releasably in a cocked position.

A slide bar spring 72 is interposed between the forward end of the latch bar and the confronting surface of the housing 50, to urge the latch bar rearwardly into abutment with the upper end of a trigger arm 74 which is mounted in the housing 50 by pivot pin 76 extending through the trigger arm intermediate the ends thereof. The lower end portion of the trigger arm forms a finger-operated trigger 78.

The overlapping engagement area 70 is adjustable for varying the sensitivity of operation of the trigger arm 74. In the embodiment illustrated, a sensitivity adjustment screw 80 is threaded through a bore in the upper end of the trigger arm for abutment against the rearward end of the slide bar 68. An access opening 82 in the base plate 10 and housing 50 accommodates a tool for rotating the adjustment screw 80.

A safety pin 84 is provided for securing the trigger arm against inadvertent operation. The safety pin is mounted in a guide opening 86 in the housing 50 for movement in the lateral direction of the housing. The safety pin is provided with a notch 88 dimensioned to receive the finger-operated trigger 78 of the trigger arm when the safety pin is moved to the safety-off position. When the safety pin is moved to offset the notch from registry with the finger trigger 78, the trigger arm is secured against rearward movement of the finger trigger end and thereby prevent accidental firing of the slinger.

Lateral movement of the safety pin is controlled by means of a detent retainer pin 90 mounted slidably in an opening in the housing 50. A coil spring 92 bears at one end against the pin 90 and at the opposite end against a backing screw 92' to urge the retainer pin into a longitudinal guide groove 94 in the safety pin. The retainer pin thus secures the safety pin against axial rotation while allowing axial movement of the safety pin to the limits determined by the safety pin lock pocket 96 and the safety pin release pocket 98. As best illustrated in FIG. 10, when the retainer pin is located in registry with the lock pocket, the notch 88 is displaced laterally from the finger trigger end 78, to prevent pivoting of the trigger arm. When the retainer pin is in registry with the release pocket 98, the notch 88 is moved to the broken line position of FIG. 10 in registry with the trigger 78 to allow operation of the trigger arm.

In FIG. 8 of the drawings there is shown a pair of resilient impact pads 100 and 100' mounted on the housing 50 immediately forward and rearward of the releasable latch bar 54. The pads are secured to the housing by the attaching screws 102. The impact pads serve to cushion the shock of impact of the latch bar when it flails forceably forward and rearward when released by the trigger arm, as described hereinafter.

Referring primarily to FIG. 8 of the drawings, the projectile arrow 28 is shown to be provided at its rear end with a nock 104, and the connecting cord 48 is configured for reception in the nock. FIG. 3 of the drawings shows the arrow 28 as being provided with a point element 106. In the preferred embodiment, the point element is made of magnetically susceptible material, such as steel, for attraction to magnetic means mounted on the guide track. As illustrated in FIG. 3, a pair of magnets 108 are secured in the barrel bores 20 to opposite sides of the track 22 in registry with the arrow point 106 when the arrow is positioned on the track with the nock 104 engaging the connecting cord 48. The arrow thus is secured to the track by means of the magnets 108 at the arrow point 106 and at the nock 104 secured in the connecting cord 48 held by the latch bar 54. The slinger thus may be manipulated freely, as by being carried in a vehicle or in the hand during walking through a hunting site, or other activity, in cocked position in readiness for firing.

The slinger of this invention also is capable of use with darts, which are smaller length arrows. For this purpose a second pair of magnets 110 are secured in the barrel bores 20 a distance from the connecting cord 48 retained by the locked latch bar 54, for registry with a magnetically susceptible point at the front end of the dart, similar to the point 106 for the arrow 28.

The operation of the slinger is as follows: The front anchor plate 36 is raised to the operative position in front of the track base and barrels, the elastic band connecting cord 48 is grasped in the fingers and pulled rearward to stretch the bands toward the rear. The connecting cord is placed behind the latch bar 54, which is latched in cocked position by mutual contact of the base and slide surface engagement area 70. A projectile, such as arrow 28, is placed on the guide track 22 and moved rearward to extend the arrow through the slot 64 and engage the connecting cord 48 in the arrow nock 104. The point 106 of the arrow registers with the magnets 108 and is thereby secured magnetically against the track.

In this loaded condition the slinger may be carried in a vehicle for movement over the road or in the hand while walking, as over a hunting site. It is to be understood, of course, that the safety pin 84 will have been moved to the safety position shown in full lines in FIG. 10 to prevent accidental activation of the trigger arm 74 and firing of the slinger.

When the arrow is to be projected from the slinger, the safety pin is moved to register the notch 88 with the trigger arm 74, to release the latter. The slinger is raised to the shoulder, in the manner of a rifle, is aimed at a target, and the finger-operated trigger 78 is pulled back by finger action. As the trigger arm is pivoted, counterclockwise in FIG. 8, the slide bar 68 is pushed forward against the compressive force of the spring 72, thereby disengaging from the base surface 66 of the trigger arm 74. The tensioned elastic bands 32 and 34 thereupon rotate the latch bar 54 rapidly and forcibly counterclockwise about the axis of its pivot pin 56, to the broken line release position shown in FIG. 8. The connecting cord 48, with engaged arrow, is thrust forward rapidly and with minimum friction by moving over the rollers 60. The flailing movement of the latch bar is cushioned by engagement with the shock-absorbing impact pads 100 and 100'.

The rapid contraction of the elastic bands 32 and 34 moves the connecting cord 48, with engaged arrow nock 104, rapidly and forcibly forward, thrusting the arrow forwardly as it is guided along the track. When the connecting cord 48 passes the front anchor plate 36 and continues its forward movement, the anchor plate pivots, counterclockwise about the axis of pivot pin 38 to the position shown in FIG. 2. The elastic bands thus are extended fully forward, giving maximum thrust to the arrow. In contrast, when the anchor plate 36 is secured in fixed position against pivoting, the elastic bands are caused to be doubled, or kinked, as they pass forwardly past the rearwardly extending attachment studs 40. This not only shortens the forward thrust, but it shortens the operational life of elastic bands by the repetitive kinking.

From the foregoing description, it will be appreciated that the elastic band projectile slinger of this invention overcomes the disadvantages and limitations of prior such elastic slingshot-type devices, by providing for carrying of the slinger in loaded but safe condition while walking or other activity; by minimizing friction wear on the elastic band connecting cord 48 during release; by maximizing the thrust of the elastic band assembly by the pivoted front anchor plate 36; and by maximizing the operating life of the elastic bands by eliminating the doubling, or kinking of the bands as they thrust forward of a normally fixed front anchor.

It will be apparent to those skilled in the art that various changes and modifications may be made in the size, shape, type and number of parts of the slinger described hereinbefore. For example, the connecting cord 48 may be configured with a pocket for containing a ball-type projectile, such as a marble, a ball bearing, buckshot and other like objects. For this purpose the projectile slot 64 must be widened to accommodate the pocket. The doubled elastic bands 32 and 34 may be replaced with single bands if less thrust is desired, or with extra bands if greater thrust is required. These and other changes may be made without departing from the spirit of this invention and the scope of the appended claims.

I claim:

1. An elastic band projectile slinger, comprising:

a) an elongated base member having front and rear ends, b) a projectile guide track extending along the base member and configured to support and guide a projectile for movement toward the front end of the base member, c) an elongated elastic band member forming a pair of elongated strands having front and rear ends, d) an elastic band anchor member mounted on the front end of the base member for substantially 180° pivotal movement between an upright position projecting above the guide track and a retracted position extending below the guide track, e) attaching means on the anchor member securing the front end of the elastic band member thereto, f) an elastic band latch member mounted on the base member adjacent the rear end thereof for movement between an operative position retaining the rear end of the elastic band member when the elastic band member is stretched rearwardly from the upright position of the anchor member to engage said latch member, and a release position disengaged from the elastic band member, whereby the elastic band member is caused to contract forwardly from said stretched condition and thrust the rear end of the elastic band member forwardly of the front end of the base member and pivot the anchor member to said retracted position, g) projectile engaging means on the rear end of the elastic band member for engaging a projectile supported on the guide track when the rear end of the elastic band member is retained in the latch member, and h) a trigger member mounted on the base member adjacent the rear end thereof for movement between a cocked position securing the elastic band latch member in said operative position and an uncocked position disengaging the latch member for movement to said release position.

2. The elastic band projectile slinger of claim 1 for use with an elongated projectile having a front point member of magnetically susceptible material and a rear end configured to engage the rear end of the elastic band member, the slinger including magnet means on the base member positioned for registry with the front point member of the projectile when a rear end of the projectile engages the elastic band member in its stretched position retained by the latch member, whereby the projectile is secured to the guide track at the front and rear ends of the projectile.

3. The elastic band projectile slinger of claim 2 wherein the rear end of the elastic band member is arranged to engage the rear hock end of an elongated projectile.

4. The elastic band projectile slinger of claim 2 wherein the base member includes a pair of laterally spaced elongated hollow tubes defining the guide track between them, and the magnet means is mounted in at least one of said hollow tubes.

5. The elastic band projectile slinger of claim 2 wherein magnet means are mounted on the base member at different positions forwardly of the latch member for registry with the front point member of elongated projectiles of different lengths.

6. The elastic band projectile slinger of claim 5 wherein the base member includes a pair of laterally spaced elongated hollow tubes defining the guide track between them, and the magnet means are mounted in at least one of said hollow tubes.

7. The elastic band projectile slinger of claim 1 including impact absorbing pad means on the base member forward and rearward of the elastic band latch member arranged for abutment by the elastic band latch member when the elastic band member is released therefrom.

8. The elastic band projectile slinger of claim 1 wherein the trigger member is an elongated arm mounted pivotally intermediate its ends and forming a lower finger-operated trigger portion and an upper actuator portion, a slide bar mounted on the base member for movement between a latching position engaging the latch member and securing it in said upright position and a release position disengaging the latch member, and spring means interengaging the base member and slide bar and urging the slide bar resiliently into abutment with the upper actuator portion of the trigger member for movement by operation of the finger trigger portion of the trigger member.

9. The elastic band projectile slinger of claim 8 including a sensitivity adjustment member on the upper portion of the trigger member arranged for engagement with the slide bar to adjust the area of contact of the slide bar with the latch member.

10. The elastic band projectile slinger of claim 8 including a safety member on the base member for movement between an operative position engaging the trigger member to prevent its movement to said uncocked position and a release position permitting movement of the trigger member to said uncocked position.

11. The elastic band projectile slinger of claim 10 wherein the safety member comprises a pin mounted for movement transversely of the trigger member, a notch in the pin is arranged to register with the trigger member when in said release position and to be displaced from the trigger member when in said operative position.

12. The elastic band projectile slinger of claim 11 including detent means on the base member resiliently engaging the safety pin, and a groove in the safety pin receiving the detent means for limiting movement of the safety pin between said release and operative positions.

13. The elastic band projectile slinger of claim 1 for use with an elongated projectile having a front point member of magnetically susceptible material and rear nock end configured to engage the rear end of an elastic band member, the projectile slinger including:

a) impact absorbing pad means on the base member forward and rearward of the elastic band latch member arranged for abutment by the elastic band latch member when the elastic band member is released therefrom, b) magnet means on the base member positioned for registry with the front point member of a projectile when the rear end of the projectile engages the elastic band member in its stretched position retained by the latch member, whereby the projectile is secured to the track guide at the front and rear ends of the projectile, c) the trigger member includes an elongated arm mounted pivotally intermediate its ends and forming a lower finger-operated trigger portion and an upper actuator portion, a slide bar mounted on the base member for movement between a latching position engaging the latch member and securing it in said upright position and a release position disengaging the latch member, and spring means interengaging the base member and slide bar and urging the slide bar resiliently into abutment with the upper actuator portion of the trigger member for movement by operation of the finger trigger portion of the trigger member, d) a sensitivity adjustment member is mounted on the upper portion of the trigger member and arranged for engagement with the slide bar to adjust the area of contact of the slide bar with the latch member, e) a safety member is mounted on the base member for movement between an operative position engaing the trigger member to prevent its movement to said uncocked position and a release position permitting movement of the trigger member to said uncocked position, the safety member comprising a pin mounted for movement transversely of the trigger member, a notch in the pin is arranged to register with the trigger member when in said release position and to be displaced from the trigger member when in said operative position, and f) detent means on the base member resiliently engages the safety pin, and a groove in the safety pin receives the detent means for limiting movement of the safety pin between said release and operative positions.

14. The elastic band projectile slinger of claim 13 wherein the base member includes a pair of laterally spaced elongated hollow tubes defining the guide track between them, and the magnet means is mounted in at least one of said hollow tubes.

15. The elastic band projectile slinger of claim 1 including roller means on the elastic band latch member for rolling engagement with said elastic band member during release thereof.

* * * * *

UNITED STATES PATENT AND TRADEMARK OFFICE

CERTIFICATE OF CORRECTION

PATENT NO. : 5,642,723

DATED : 1 July 1997

INVENTOR(S) : HOWARD W. HOGAN

It is certified that error appears in the above-identified patent and that said Letters Patent is hereby corrected as shown below:

Column 6, line 6, "the" (last occurrence) should read: --a--.

Column 6, line 13, "hock" should read: --nock--.

Signed and Sealed this

Twenty-third Day of September, 1997

*Attest:*

*Attesting Officer*

BRUCE LEHMAN

*Commissioner of Patents and Trademarks*